United States Patent [19]

Totsu

[11] Patent Number: 4,541,266

[45] Date of Patent: Sep. 17, 1985

[54] RIVETING MOTOR TOOL

[75] Inventor: Katsuyuki Totsu, Higashi-Mukojima, Japan

[73] Assignee: Hios Inc., Tokyo, Japan

[21] Appl. No.: 580,549

[22] Filed: Feb. 14, 1984

[30] Foreign Application Priority Data

Feb. 21, 1983 [JP] Japan ..... 58-27285

[51] Int. Cl.[4] ..... B21D 31/00

[52] U.S. Cl. ..... 72/391; 72/449

[58] Field of Search ..... 72/449, 391, 114; 74/32, 34; 173/133, 132, 119, 112; 29/243.53

[56] References Cited

U.S. PATENT DOCUMENTS

| | | | |
|---|---|---|---|
| 1,803,307 | 4/1931 | Wodack | 173/119 |
| 2,406,949 | 9/1946 | Huck | 72/391 |
| 3,033,410 | 5/1962 | Hanneman | 72/391 |
| 3,321,033 | 5/1967 | Benuska | 173/119 |
| 3,822,595 | 7/1974 | Elflein | 173/119 |
| 3,933,025 | 1/1976 | Briles | 72/391 |
| 4,137,747 | 2/1979 | Clarke et al. | 72/391 |
| 4,218,911 | 8/1980 | Johnston | 72/391 |

FOREIGN PATENT DOCUMENTS

| | | | |
|---|---|---|---|
| 130755 | 5/1978 | Fed. Rep. of Germany | 72/391 |

OTHER PUBLICATIONS

Henery T. Brown, "Mechanical Movements", 1893, pp. 24, 25, No. 81.

*Primary Examiner*—Daniel C. Crane
*Assistant Examiner*—David B. Jones
*Attorney, Agent, or Firm*—Young & Thompson

[57] ABSTRACT

A riveting motor tool for use in fastening a pop rivet in which a fastening shank of the rivet having an enlarged end is inserted into a flanged sleeve body and the fastening shank is grasped to be torn off for forming a splayed portion at a free end of the sleeve. The tool grasps the fastening shank and is withdrawn by a slide shaft that is reciprocated by a rotary drive. Springs urge the shaft in the opposite direction. The rotary drive has teeth spaced apart from each other a distance greater than the stroke of the shaft, that engage with a lug on the shaft having arcuate recesses on each side of the lug for reception of the teeth, the rotary drive being reversible to engage the lug from either side. The shaft is hollow and torn off portions of the shank move lengthwise through the shaft out the rear end of the shaft which is disposed in a receptacle for receiving and retaining these torn off portions.

1 Claim, 7 Drawing Figures

FIG. 1
PRIOR ART
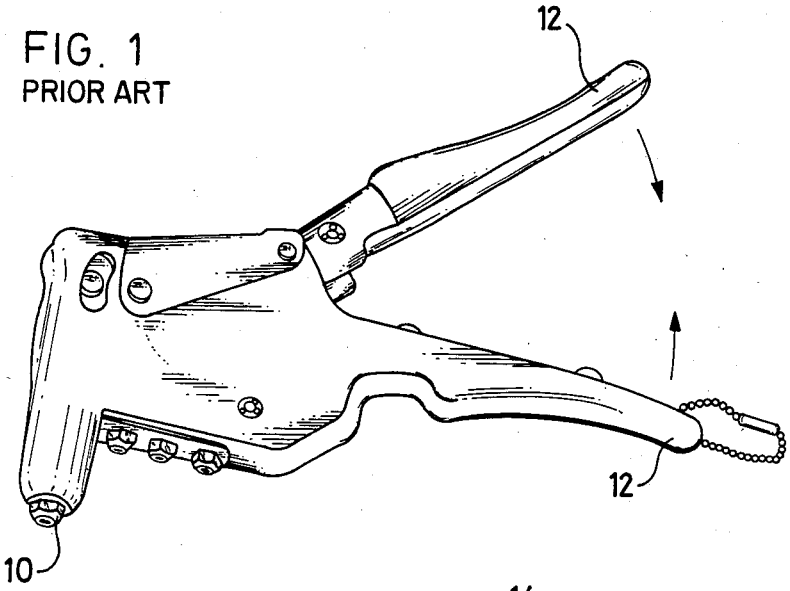
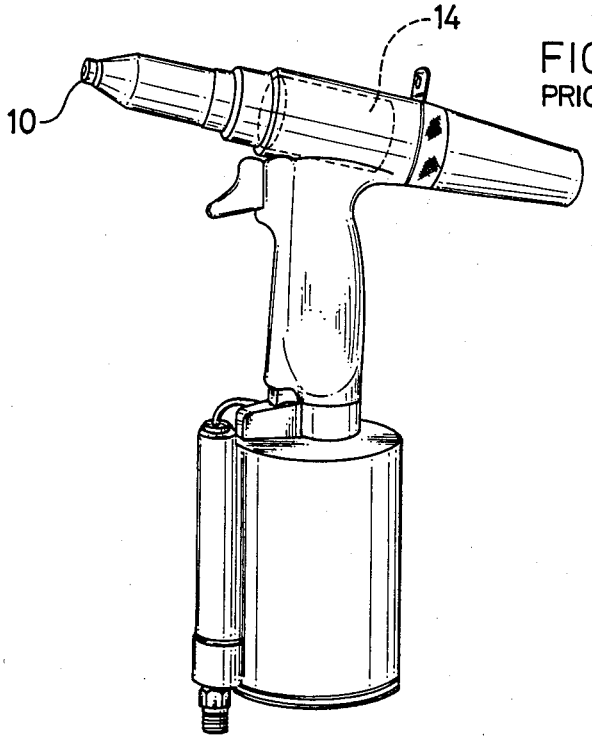
FIG. 2
PRIOR ART

RIVETING MOTOR TOOL

FIELD OF THE INVENTION

This invention relates to a riveting tool, more particulaly to a riveting motor tool which is suitably used for fastening a rivet, so-called a "blind rivet" or "pop rivet" wherein a fastening shank having an enlarged end is inserted into a flanged sleeve body and then a protruding portion of the shank is forcibly torn off for splaying an end of the sleeve body to fasten a plurality of elements each other.

BACKGROUND OF THE INVENTION

As fastening tool using a pop rivet, there has been proposed and utilized a manual riveting tool wherein a fastening shank of the pop rivet is inserted into a nose piece 10 of the tool, as shown in FIG. 1, and is grasped with a pair of jaws while a head portion of the rivet is abutted against the margins of a hole of one element to be fastened and then levers 12, 12 of the tool are closed toward each other to allow an associated ratchet mechanism to operate the jaws for tearing off the protruding shank portion forcibly, or a pneumatic riveting tool wherein a fastening shank of the pop rivet is grasped by a pair of jaws which are pulled by compressed air introduced into a cylinder tube 14, as shown in FIG. 2.

However, the manual riveting tool has a disadvantage in that the stroke length for tearing off the shank is so short that the levers must be repeatedly operated for fastening a single rivet, resulting in troublesome and fatiguing operation. On the other hand, the pneumatic riveting tool has a disadvantage in that a compressor and air tubing are required for feeding the compressed air, leading to an inconvenient and large tool.

Thus, a general object of the invention is to provide a riveting motor tool which is portable and convenient in the fastening operation.

SUMMARY OF THE INVENTION

A principal object of the invention is to provide a riveting motor tool for a pop rivet in which a fastening shank of the rivet having an enlarged end is inserted into a flanged sleeve body and the fastening shank is grasped to be torn off for forming a splayed portion at a free end of the sleeve, characterized in that the riveting motor tool comprises a grasping means for the fastening shank, an axially pulling means connected to the grasping means, a rotary driving means engaged with the pulling means, and a motor connected to the rotary driving means through a reduction mechanism, as well as restoring means for returning the grasping means and/or the pulling means to their initial positions.

BRIEF DESCRIPTION OF THE DRAWINGS

FIGS. 1 and 2 are perspective views of conventional riveting tools for setting pop rivets;

PREFERRED EMBODIMENTS OF THE INVENTION

The riveting motor tool according to the invention may be formed in a compact, portable and convenient manner, wherein grasping means for the fastening shank is connected to axially pulling means to move the latter axially under the action of rotary driving means for forcibly tearing off a protruding portion of the fastening shank and then the grasping means and/or the pulling means are restored to their initial positions.

Furthermore, the fastening operation may be efficiently carried out by the riveting motor tool of the invention wherein the grasping means comprises a booster head provided at its one end with a nose piece, a jaw casing fitting into the booster head, and a pair of jaws arranged within the jaw casing and resiliently urged against an open end of the jaw casing by an urging means, the jaw casing being connected to a slide shaft which is axially reciprocable within the tool body, through which passes an axial hole and which is provided with a drive lug, and wherein the rotary driving means comprises a pinion gear having a plurality of teeth for engaging the lug of the slide shaft in which the teeth of the pinion gear are spaced apart from each other by a distance greater than the stroke length from a position of tearing off the fastening shank by the grasping means to a restored initial position, thereby to prevent the subsequent tooth from engaging the lug of the slide shaft.

Furthermore, in the riveting motor tool according to the invention, the power-transmission system including a reduction mechanism may be protected upon a reverse rotation of the motor by an arrangement in which a unidirectional mechanism for transmitting the power only in a positive rotational direction is arranged between the pinion gear and the rotary shaft of the rotary driving means, or in which a flange is provided at the other end of the booster head which on its outer side is fitted with a supporting cylinder connected to the tool body, and a spring is inserted between the flange and the supporting cylinder for resiliently supporting the booster head in the axial direction.

Furthermore, as the restoring means for returning the grasping means and/or the pulling means to their original positions, there may be preferably used springs inserted between the jaw casing and the tool body.

For better understanding, the invention will be described hereinafter in its preferred embodiments in more detail with reference to the accompaning drawings.

Figure 3:
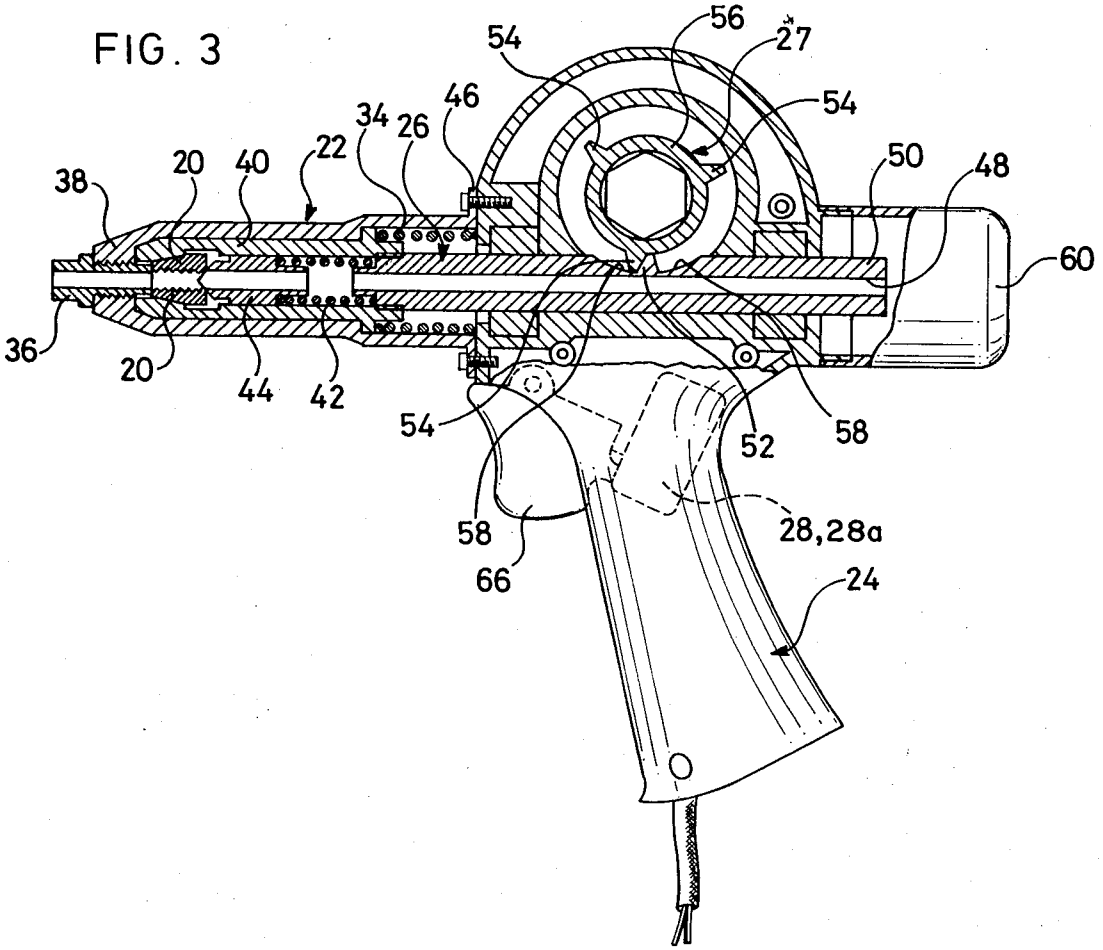
FIG. 3 is a schematic sectional view of a riveting motor tool according to the invention.
Figure 4:
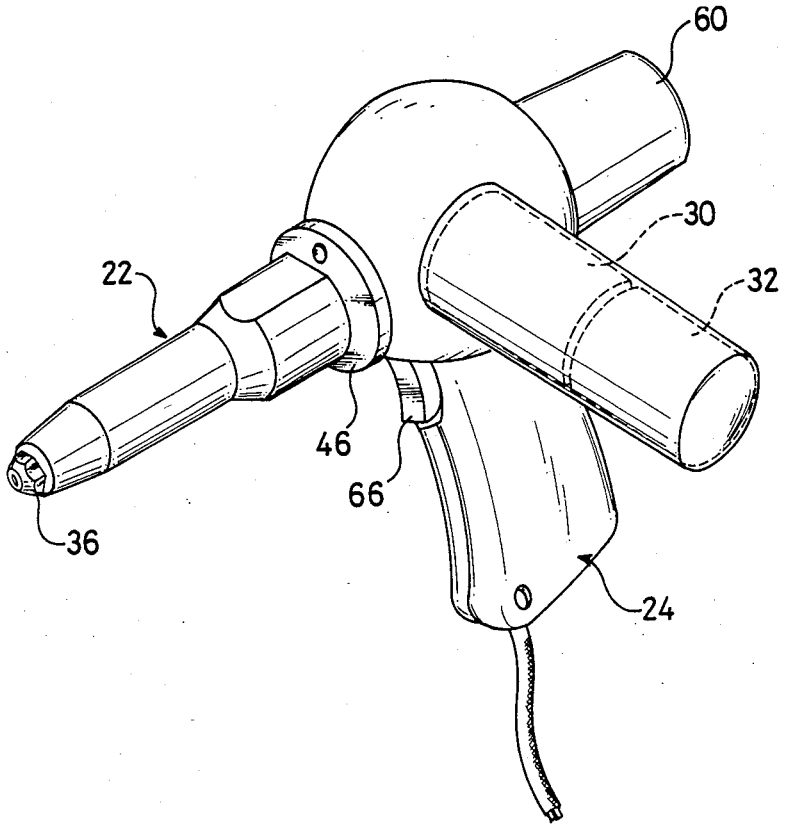
FIG. 4 is a perspective view of the riveting motor tool as shown in FIG. 3.
Figure 5A:
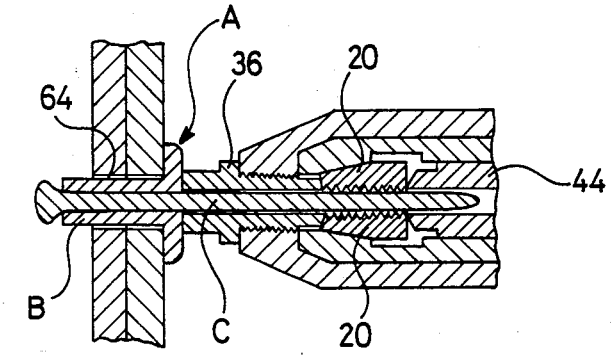
FIGS. 5*a* to 5*c* are schematic views illustrating the fastening procedure of the pop rivet.
Figure 5B:
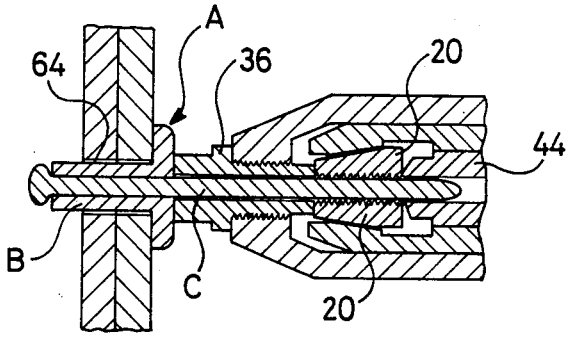
Figure 5C:
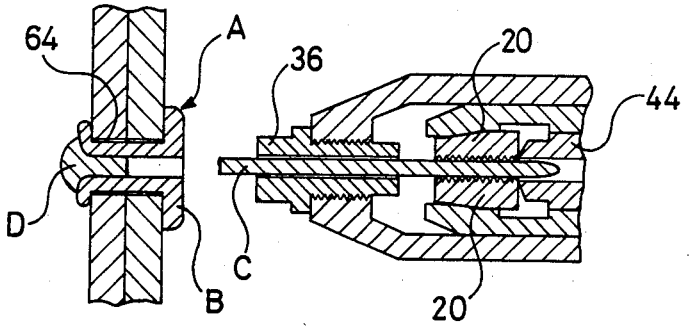

Referring to FIGS. 3 and 4, the riveting motor tool according to the invention comprises a grasping means 22 including a pair of jaws 20, 20 for grasping the fastening shank of the pop rivet and a grip 24, and further comprises a pulling means 26 for pulling the jaws 20, 20 axially, a rotary driving means 27 for reciprocating the pulling means 26, a motor 32 for rotating the rotary driving means 27 through a reduction mechanism 30 utilizing a planetary mechanism under the control of a switch 28, and a spring 34 for restoring the pulling means 26 to its initial position. A commercial electric source (FIG. 3) or a battery replaceably mounted in the grip 24 (FIGS. 6 and 7) may be utilized as a power source for driving the motor 32.

The grasping means 22 comprises a booster head 38 provided at its one end with a replaceable nose piece 36 having a throughhole of a predetermined diameter, a jaw casing 40 fitting into the booster head 38, and a pair of jaws 20, 20 arranged within the jaw casing 40 and resiliently urged against an open end of the jaw casing 40 under the action of a coil spring 42 and a pusher 44. The booster head 38 is mounted or an end of the grip 24 through a flange 46 which is provided at the other end of the booster head 38.

The pulling means 26 is provided with an axial throughhole 48 and consists of a slide shaft 50 threaded at its one end within the jaw casing 40. The rotary driving means 27 comprises a pinion gear 56 having a plurality of teeth 54 for engaging a lug 52 provided at a perdetermined position on the slide shaft 50. The pinion gear 56 is connected to a rotary shaft of the motor 32 for ensuring axial reciprocation of the slide shaft 50. In this case, play portions 58, 58 are arranged on either side of the lug 52 of the slide shaft 50 for permitting rotation of the teeth 54 of the pinion gear 56. Furthermore, the teeth 54 of the pinion gear 56 are spaced apart from each other a circumferential distance which is greater than the stroke length of the slide shaft 50 from a position for tearing off the fastening shank to a restored initial position, thereby to prvent the subsequent tooth from engaging the lug 52 of the slide shaft 50. A coil spring 34 is inserted between one end of the jaw casing 40 and one end of the grip 24 for urging the jaw casing 40 against the booster head 38. Thus, when the lug 52 of the slide shaft 50 is in a non-engaging position with the tooth 54 of the pinion gear 56, the jaw casing 49 may be resiliently urged against a predetermined portion (a step portion) of the booster head 38, while the jaws 20, 20 in the jaw casing 40 are normally urged against the nose piece 36 by the coil spring 42 and the pusher 44, thereby to be kept open by the nose piece 36.

In FIGS. 3 and 4, reference numeral 60 represents a storage for receiving scraps of the shank portions of the rivets torn off by the jaws 20, 20.

The operation and effect of the riveting motor tool according to the invention will be described hereinbelow with reference to FIGS. *5a* to *5c*.

In use of the riveting motor tool according to the invention, a sleeve body B of a pop rivet A is passed through a hole 64 provided at a predetermined position in two plate elements. Thereafter, a fastening shank C of the pop rivet A is inserted through the sleeve into the hole of the nose piece 36 and between the jaws 20, 20. In this case, the jaws 20, 20 are urged against one end of the nose piece 36 and kept open (FIG. *5a*).

Then, an operating element 66 of the grip 24 is pushed for actuating the switch 28 thereby to transmit the rotational force of the motor 32 through the reduction mechanism 30 to the pinion gear 56 for engaging its teeth 56 with the lug 52 of the slide shaft 50. Thus, the slide shaft 50 and the jaws 20, 20 threaded thereon are moved in the right within the jaw casing 40 (FIG. *5b*). Since the jaws 20, 20 in the jaw casing 40 are urged toward the nose piece 36 under action of the coil spring 42 and the pusher 44, the fastening shank C may be securely grasped by teeth of the jaws.

Then, when the slide shaft 50 is further moved toward the right through rotation of the motor 32, one end of the sleeve body B is splayed by the enlarged portion D of the fastening shank C thereby to connect the plate elements with the rivet. Upon further movement of the slide shaft 50 to the right, the fastening shank C is torn off at its neck portion by the jaws 20, 20 (FIG. *5c*).

Scraps of the shanks C torn off by the jaws 20, 20 are introduced through the hole 48 of the slide shaft 50 into the storage 60 and discharged optionally. After the jaws 20, 20 have torn off the fastening shank, the slide shaft 50 is moved to the left due to the resilient force of the coil spring 34 and resumes its initial position for the next riveting operation (FIG. 3).

In accordance with the riveting motor tool of the invention, the slide shaft is reciprocated through the pinion gear driven by the motor for tearing off the fastening shank, resulting in a simple and convenient riveting operation, as well as a compact and portable tool.

Figure 6:
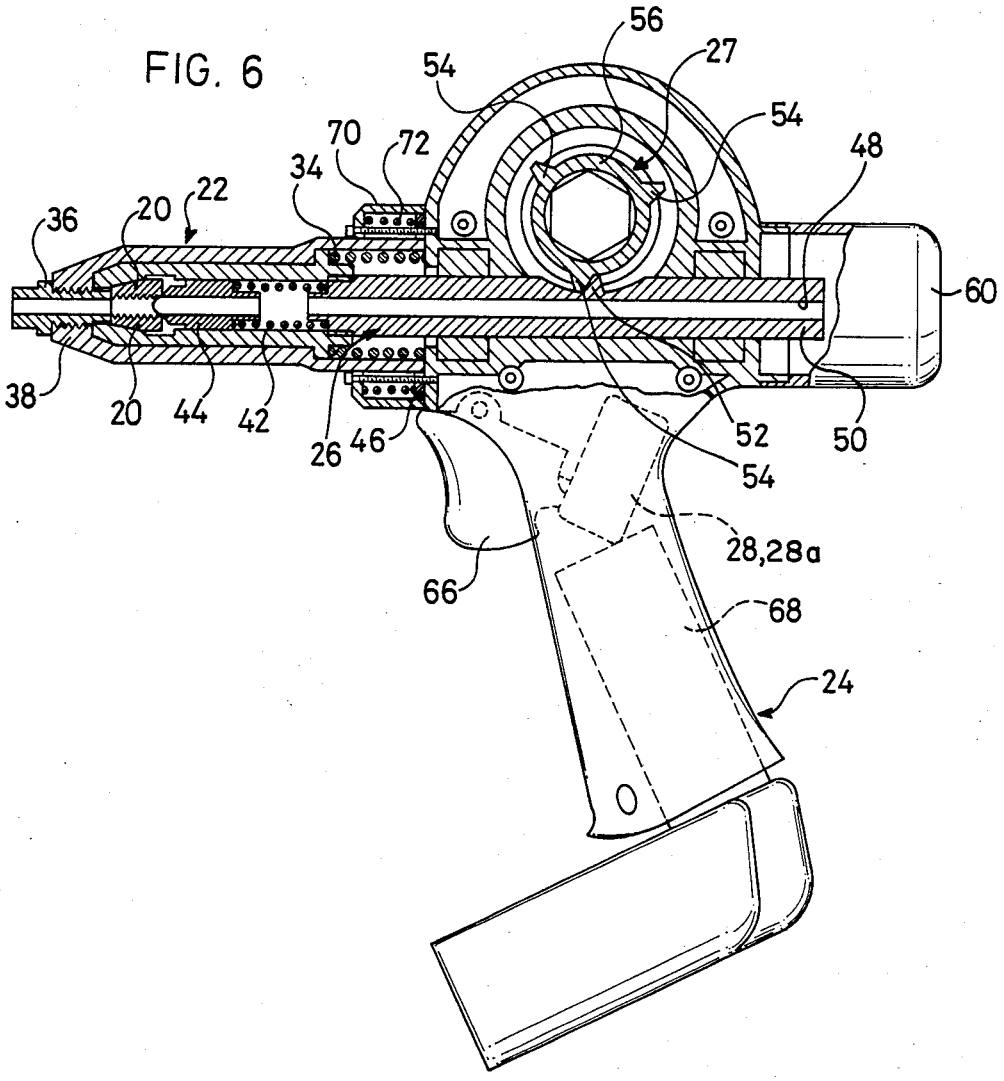
FIGS. 6 and 7 are sectional views of other embodiments of the riveting motor tool according to the invention.

FIG. 6 illustrates another embodiment of the riveting motor tool according to the invention, wherein a battery 68 replaceably mounted within the grip 24 is utilized as a driving source for the motor 32, and a supporting cylinder 70 is provided on the outside of the flange 46 of the booster head 38 and attached to a part of the grip 24. Furthermore, a coil spring 72 having a much stronger force than the coil spring 34 is arranged between the flange 46 and the cylinder 70 for resiliently urging the booster head 38 against the grip 24, and a contact 28*a* for reversely rotating the motor 32 is provided on the switch 28.

In accordance with this embodiment, the tearing off operation for the shank of the pop rivet may be carried out in the same way as in the previous embodiment but with the advantage in that when the charge of the battery 58 has been depleted by long-continued operation and becomes insufficient to allow the jaws 20, 20 to tear off the shank during the operation, the switch 28 is actuated by the operating element 66 to reversely rotate the motor 32 (upon the reversal of rotation, much less power is needed due to negligible loading), thereby to engage the tooth 54 of the pinion gear 56 with the opposite side of the lug 52 of the slide shaft 50 for urging the latter toward the left (FIG. 6) and thus advancing the booster head 38 to the extent of the moving stroke by the coil spring 72, so that a predetermined gap may be formed between one end of the booster head 38 and the front end of the jaw casing 40 for spacing the pair of jaws 20, 20 apart, thereby to release its grasping function for the fastening shank C. Thus, insufficient battery power during the riveting operation may be readily overcome.

Figure 7:
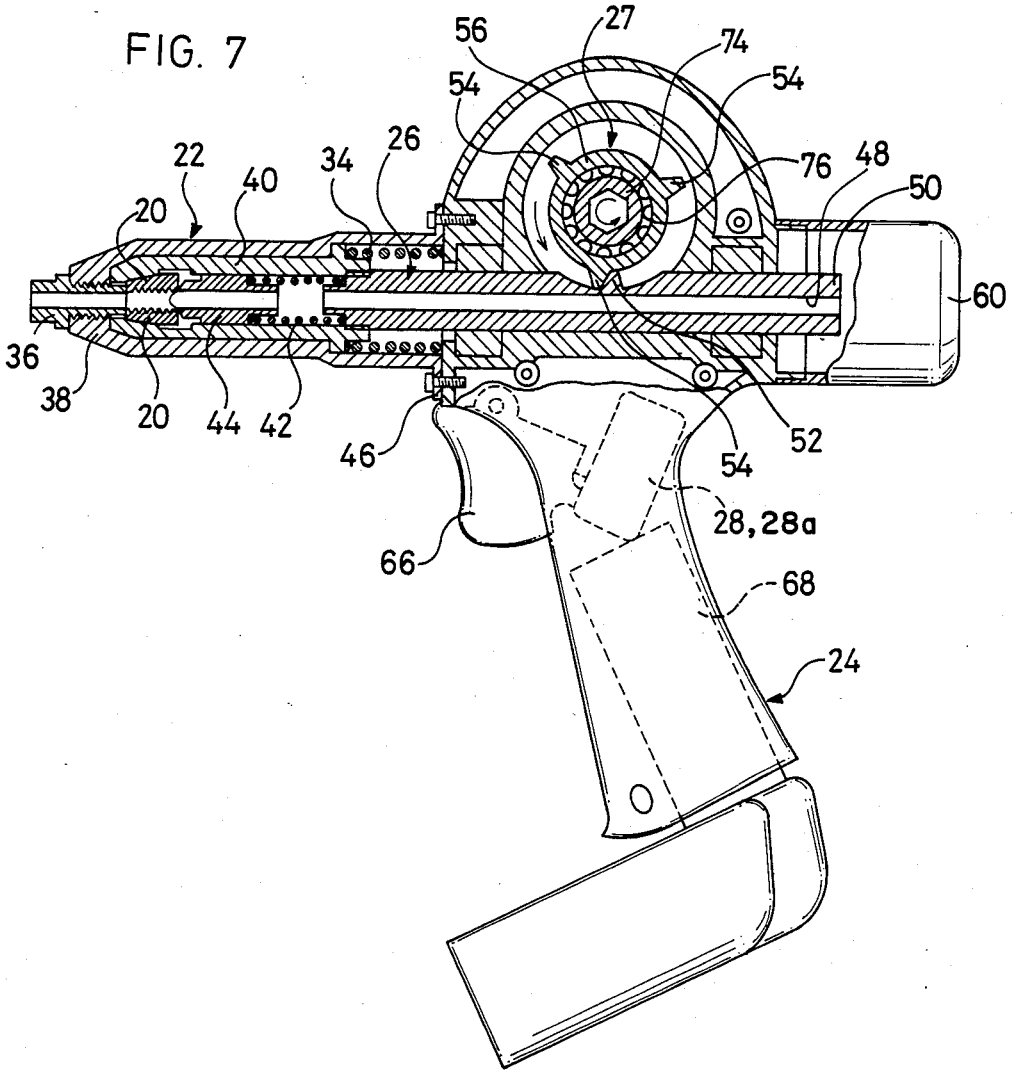

FIG. 7 illustrates a further embodiment of the riveting motor tool according to the invention, wherein the battery 68 replaceably mounted in the grip 24 is used as the power source for the motor 32 as in the embodiment of FIG. 6, with the difference that a unidirectional mechanism 76, such as an one-way clutch, is provided between an output shaft 74 (connected to the rotary shaft of the motor) and the pinion gear 56 for transmitting the power only in the positive rotational direction, as shown with an arrow in FIG. 7.

In accordance with this embodiment, when the power of the battery 68 has been depleted during the riveting operation and becomes insufficient to allow the jaws 20, 20 to tear off the shank as in the embodiment of FIG. 6, a fastening position of the output shaft 74 and the pinion gear 56 due to the one-way mechanism 76 may be released through reverse rotation of the motor 32 thereby to move the slide shaft 50 toward the left (FIG. 7) through the resilient force of the coil spring 34 arranged between one end of the jaw casing 40 and one end of the grip 24, so that the grasping function of the jaws 20, 20 on the shank C may be readily released. Thus, the supporting cylinder and the coil spring arranged between the supporting cylinder and the flange as shown in FIG. 6 may be omitted, resulting in a simplified construction and protection of the motor upon reverse rotation.

As described fully hereinabove, in accordance with the riveting motor tool of the invention, the slide shaft may be reciprocated by the pinion gear driven by the motor, so that the fastening operation may be simple and reliable, and the tool may be constructed in a compact and portable form. Furthermore, after the tearing off of the fastening shank has been completed, the jaws may be automatically restored to their initial position for the next riveting operation, so that the efficient operation may be achieved and the grasping function of the jaws may be readily released even upon insufficient battery power.

Although the invention has been described hereinabove with reference to preferred embodiments, many variations and modifications may be made without departing from the sprit and the scope of the invention, for example, the diameter of the pinion gear may be larger for increasing the stroke length thereby to provide three or more teeth for the continuous fastening operation, or the lug may be formed separately from the slide shaft and elastically attached thereto for preventing engagement of the lug with the tooth of the pinion gear upon reverse rotation of the pinion gear thereby to protect the motor upon reverse rotation, or another mechanism for converting the rotation into a linear movement may be utilized.

What is claimed is:

1. A riveting motor tool for use in fastening a pop rivet in which a fastening shank of the rivet having an enlarged end is inserted into a flanged sleeve body and the fastening shank is grasped to be torn off for forming a splayed portion at a free end of the sleeve, the riveting motor tool comprising a grasping means for the fastening shank, an axially pulling means connected to the grasping means, a rotary drive means engaged with the pulling means, a motor connected to the rotary driving means through a reduction mechanism, as well as restoring means for returning the grasping means and/or the pulling means to their initial position, said pulling means comprising an axially reciprocable slide shaft having a lug thereon engageable by teeth on said rotary drive means, said teeth being spaced apart from each other a peripheral distance greater than the stroke length of the slide shaft from the position of tearing off the fastening shank by the grasping means to a restored initial position thereby to prevent the subsequent tooth from engaging the lug of the slide shaft, the slide shaft having recesses thereon, on opposite sides of said lug, and means for reversibly actuating said rotary drive means so that said teeth approach said lug through said recesses and contact one or the other side of said lug depending on the direction of rotation of said rotary drive means, whereby upon reverse rotation of said rotary drive means said grasping means release the fastening shank of a rivet when the power of said motor is insufficient for tearing off the fastening shank.

* * * * *